United States Patent [19]

Stites

[11] 4,076,182

[45] Feb. 28, 1978

[54] VARIABLE SPEED WIRE SPOOLER

[75] Inventor: Harold W. Stites, Raytown, Mo.

[73] Assignee: Armco Steel Corporation, Middletown, Ohio

[21] Appl. No.: 757,786

[22] Filed: Jan. 10, 1977

[51] Int. Cl.[2] ..... B65H 59/00

[52] U.S. Cl. ..... 242/45; 242/75.53; 242/75.2

[58] Field of Search ..... 242/45, 75.2, 75.51, 242/75.5, 75.53, 78.1, 78.3, 82, 147 R, 67.5

[56] References Cited

U.S. PATENT DOCUMENTS

| | | | |
|---|---|---|---|
| 2,916,227 | 12/1959 | Bowen | 242/75.5 |
| 3,701,493 | 10/1972 | Welsch | 242/75.51 |
| 3,934,837 | 1/1976 | Keilhack | 242/75.53 |

*Primary Examiner*—Edward J. McCarthy

*Attorney, Agent, or Firm*—Melville, Strasser, Foster & Hoffman

[57] ABSTRACT

An improved hydraulically driven wire spooler for winding wire on spools at a uniform linear winding speed with means for manually adjusting base winding speed.

10 Claims, 3 Drawing Figures

VARIABLE SPEED WIRE SPOOLER

BACKGROUND OF THE INVENTION

1. Field of the Invention

The apparatus of the present invention relates generally to hydraulically driven wire spoolers and more particularly to a wire spooler with compensating means to provide constant linear winding speed and means for manually adjusting the base winding speed of the spooler.

2. Description of the Prior Art

The apparatus of the present invention is concerned with electro-mechanical systems for coiling or spooling wire after a wire-drawing operation, and is designed to be used generally in conjunction with a wire-drawing machine. Typical wire-drawing machines operate continuously by drawing or reducing in cross sectional area a coil of steel rod weighing several hundred pounds into wire totalling several thousand feet in length. These wire-drawing machines operate continuously with the drawn wire exiting the machine at linear speeds of approximately 3,500 feet per minute. Upon exiting the drawing machine, the drawn wire may be accumulated temporarily in coils on one of several accumulator blocks. As one block becomes filled with coiled wire, the wire will be permitted to accumulate on other blocks. A wire spooling machine, of the type contemplated by the present invention, receives the drawn wire from the accumulator blocks and coils it on removable spools. Generally, as a given spool is filled with wire, the spooling machinery stops and the filled spool is rotated to a removable position, and removed from the machine. An empty spool is then rotated into the coiling position and the machine is again permitted to operate, coiling wire on the empty spool. During this sequence of events, the wire drawing machine is continuously operating with the wire being accumulated on the accumulator blocks.

It can readily be seen that the spooler must be operated at linear wire speeds in excess of that of the wire drawing machine in order to coil the wire which has accumulated between spool changes. However, in order to avoid the condition where the wire spooling machine must be stopped in order to allow additional wire to accumulate on the accumulator blocks, the spooling machine must be operated at such a speed so as to cause less than all the accumulated wire to be exhausted before the spool has been filled.

Depending on the speed of the wire drawing machine and the extent of delay of spool changes, there can be calculated some constant linear speed at which the spool must operate so as to cause the spool to become full simultaneously with the exhausting of the accumulated wire. It is an object of the present invention to provide means whereby an operator of this type of machine can establish this constant linear speed, thereby optimizing the efficiencies of the wire drawing and wire spooling machines.

Various methods have been devised for controlling the speed of wire spooling machines. One method contemplates that the wire coil be driven by an endless flat belt in contact with the outside diameter of the coil. While this method produces good speed control it is of limited practical utility in that linear wire velocities in excess of 1,500 feet per minute cannot generally be achieved. Another approach using a wire coil driven by an eddy current electrical clutch has been shown to permit maximum practical wire drawing velocities of 3,500 feet per minute, but suffers from poor speed control. Wire spoolers driven by direct current motors give good speed control and are also capable of driving the spools at maximum practical wire drawing velocities of 3,500 feet per minute; however, direct current supplies for this type of motor are often unavailable or prohibitively expensive.

It has been found that wire spooling machines employing hydraulically driven motors overcome many of these drawbacks, while at the same time providing simplified provision for speed control. The present invention contemplates an improved means for adjusting the linear speed of such a hydraulically driven variable speed wire spooler.

SUMMARY OF THE INVENTION

A hydraulically driven variable speed wire spooler is comprised generally of a constant speed electric motor, a variable displacement pump containing a displacement control valve, a fixed displacement hydraulic motor, a spool upon which the drawn wire may be wound, a speed control arm which rides on the outside diameter of the wire coil and through a system of linkages, actuates the displacement control valve thereby modifying the rotational speed of the hydraulic motor and maintaining a relatively constant linear wire winding speed. The improvement of the present invention comprises means for manually adjusting the relationship between the speed control arm and the displacement control valve to enable the machine operator to adjust the base winding speed of the machine (i.e. the desired linear speed at which the wire is to be wound).

Means are also included to automatically stop the machine when the desired wire coil weight on the spool has been achieved.

DESCRIPTION OF THE PREFERRED EMBODIMENTS

Figure 1:
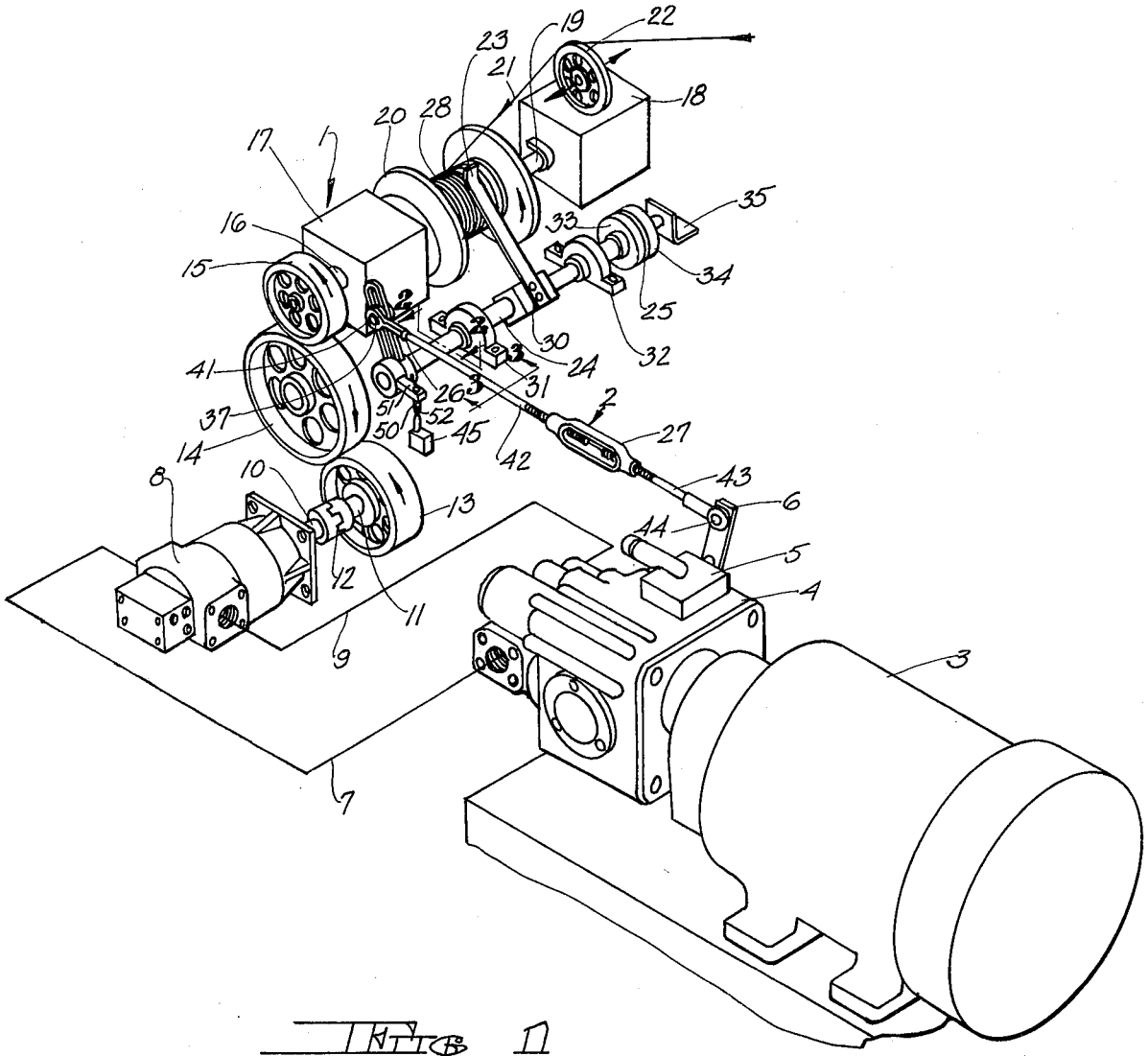
FIG. 1 is a perspective view, partly in schematic form, of a hyrdaulically driven variable speed wire spooler containing the present invention.

FIG. 1 is a perspective representation of a hydraulically driven variable speed wire spooler 1 embodying the speed control means 2 of the present invention. Spooler 1 derives its primary drive power from constant speed electric motor 3, which may be excited by either alternating or direct current. Motor 3 is coupled to and drives a hydraulic pump 4 by conventional coupling means, not shown. Pump 4 contains a displacement control valve 5 by which the output of pump 4 can be varied, as is well understood in the art. The output of pump 4 can be varied through displacement control valve 5 by means of lever arm 6 which is affixed to the valve 5. For example, when lever arm 6 is moved toward motor 3, displacement control valve 5 will tend to close, thereby decreasing the output of pump 4. On the other hand, when lever arm 6 is moved in a direction away from motor 3, displacement control valve 5 will tend to open, thereby increasing the output of pump 4. The output of pump 4 is conducted through an out put line, shown schematically at 7, to the input of fixed displacement hydraulic motor 8. The speed of hydraulic motor 8 will vary in direct proportion to the output flow from pump 4. Hydraulic fluid is returned from motor 8 to pump 4 by means of an output line, shown schematically at 9. Thus, when lever arm 6 is moved to a position closer to electric motor 3, the output flow of pump 4 will tend to decrease, thereby decreasing the output shaft speed of hydraulic motor 8. Likewise, when lever arm 6 is moved to a position away from motor 3, the output flow of pump 4 will tend to increase, thereby increasing the output shaft speed of hydraulic motor 8.

Output shaft 10 of hydraulic motor 8 is coupled to drive shaft 11 by means of coupling 12. Shaft 11 has attached at its end drive wheel 13 which rotates in the direction shown and communicates with idler wheel 14, which rotates in the direction shown. Idler wheel 14 communicates with driven wheel 15 which rotates in the direction shown. It will be understood that idler wheel 14 may be surfaced with a friction increasing substance, such as rubber or the like, to decrease slippage with drive wheel 13 and driven wheel 15. Driven wheel 15 is mounted on a shaft 16 which is rotatably supported and extends through support block 17. The opposite end of shaft 16 is rotatably supported by a similar support block 18, as at 19. Shaft 16 supports wire spool 20 upon which wire 21 from accumulator blocks (not shown) associated with a wire drawing machine may be coiled. Wire 21 may be guided to form a smooth coil on spool 20 by means of a traversing guide sheave 22, the details of which have been omitted for clarity. It will be understood that spool 20 is affixed to shaft 16 so as to rotate with it. It will also be understood that spool 20 may be removed from shaft 16 and an empty spool replaced thereon by disengaging shaft 16 from block 18 as is well understood in the art.

The speed control means of the present invention are shown generally at 2 in FIG. 1 and consist of a speed control arm 23, speed control shaft 24, dampening means 25, speed range adjust lever 26, and control link 27.

Speed control arm 23 bears against the outside diameter of wire coil 28 and is held in place against the outside diameter of coil 28. The lower end of speed control arm 23 is non-rotatively affixed to speed control shaft 24 as at 30. Speed control shaft 24 is supported by journals 31 and 32, which permit shaft 24 to rotate freely. Thus, when the diameter of wire coil 28 increases, speed control arm 23 will be caused to move upwardly and outwardly, thereby causing speed control shaft 24 to rotate in a clockwise direction as viewed from the end containing speed range adjust lever 26. The end of shaft 24 opposite from adjust lever 26 is affixed to the rotatable portion 33 of frictional dampening clutch 25. The stationary portion 34 of dampening clutch 25 is held motionless by rigidly mounted bracket 35. It will be understood by one skilled in the art that as speed control arm 23 moves upwardly and outwardly causing shaft 24 to rotate in a clockwise direction as viewed from the end containing speed range adjust lever 26, clutch 25 will provide frictional resistance to the rotation of shaft 24 thereby preventing arm 23 from bouncing on the surface of coil 28, and providing oscillation dampening. When coil 28 has reached the desired weight, spool 20 may be removed from shaft 16. Since clutch 25 frictionally resists rotation of shaft 24, arm 23 will remain in a raised position until manually lowered against the core of an empty spool 20.

Figure 2:
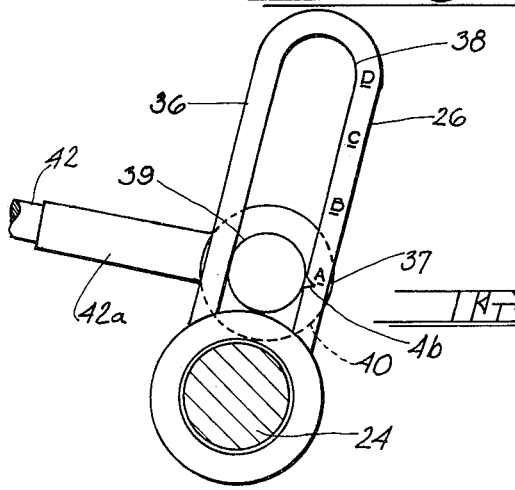
FIG. 2 is a detailed cross sectional view taken along section line 2—2 showing the speed range adjust lever.
Figure 3:
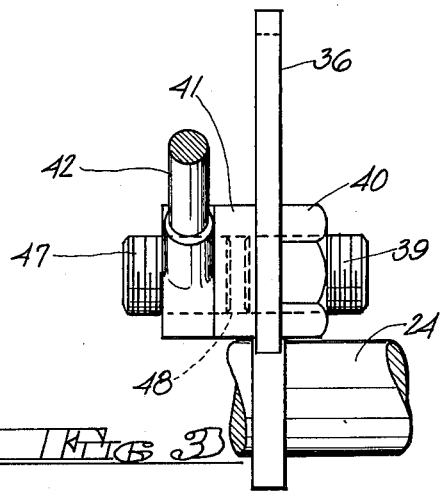
FIG. 3 is a detailed cross sectional view taken along section line 3—3.

Shaft 24 also supports speed range adjust lever 26, which consists of slotted lever arm 36 and slide assembly 37. The lowermost end of slotted lever arm 36 is rigidly affixed to shaft 24 so as to rotate with shaft 24. The upper portion of slotted lever arm 36 contains a slot 38 in which the central shaft 39 of slide assembly 37 is free to move. Slide assembly 37 may consist of a shoulder bolt or pivot pin as is shown most clearly in FIG. 3. Slide assembly 37 may be restrained at any point along slot 38 by tightening nut 40 which threadedly engages shaft 39, thereby permitting slotted lever arm 36 to be held firmly between nut 40 and boss 41. Shaft 39 is nonrotatably attached to boss 41. Slide assembly 37 also contains a second shaft 47 which is free to rotate within boss 41 and which rotatably supports rod end **42*a*. Shaft 47 is constructed so as to permit rod end 42*a* to pivot with respect to slotted lever arm 36, but is prevented from becoming disengaged from boss 41 by means of an internal C-ring 48 or similar restraint. This arrangement permits slide assembly 37 to be maintained at any point along slot 38 while at the same time permitting rod end 42*a* to pivot freely with respect to slotted lever arm 36. Slotted lever arm 36 contains a series of index markings, as for example A through D, as are shown in FIG. 2, which enables the operator of spooler 1 to set the spooling speed for particular wire spooling conditions, as will be described hereinafter. A small pointer 46 located with slide assembly 37** provides a visual indication of the speed setting.

Slide assembly 37 is rigidly attached through rod end **42*a* to rod-like link 42 which is threadedly engaged in control link 27, which may be a turnbuckle or similar connecting member. The other end of control link 27 is threadedly engaged in rod-like link 43 which is essentially colinear with link member 42. The free end of link 43 is rotatably connected to lever 6 as at 44**.

Spooler 1 may also be provided with limit sensing means which is so arranged as to be activated when shaft 24 has rotated through a predetermined number of degrees, indicating that wire coil 28 has reached a desired weight. As shown in FIG. 1, the limit sensing means comprises a switch means 45 which is activated by a push rod 50 supported by paddle 51 projecting from one end of shaft 24. As spool 20 is filled and shaft 24 rotates, push rod 50 is brought into contact with switch means 45 activating switch means 45 when coil 28 has reached the desired weight. Push rod 50 may be threadedly received in paddle 51, as at 52, so as to provide means for manually adjusting the point at which switch 50 becomes activated corresponding to a desired finished weight of the wire spool 20. Upon being activated, switch means 45 may operate to deenergize motor 3, in any conventional manner (not shown), such as interupting electrical power supplied to motor 3 thereby stopping the rotation of spool 20. It will be understood that the inherent braking of a hydraulically driven motor system, such as that employed in a variable speed wire spooler, will cause spool 20, to come quickly to a halt.

In operation, the operator wire spooler 1 places an empty spool on shaft 16 and engages the free end of shaft 16 in block 18. The operator then positions transversing guide sheave 22 so as to guide wire coil 21 to the proper position on the spool 20, and starts wire coil 28 by manually winding several turns of wire on spool 20. It will be understood by one skilled in the art that a safety interlock may be included with arm 23 whereby the machine cannot be started until arm 23 is manually engaged against spool 20. Means may also be included, such as covering or shield for the spooler, to prevent inadvertent operation thereof until the covering or shield is properly in position. Depending on the wire production output rate of the wire drawing machine with which the spooler is used, the desired linear wire speed, the particular diameter of the wire to be spooled, the wire lay, the wire chemistry and the desired finished size or weight of the spool wire, the operator will adjust slide assembly 37 in speed range adjust lever 36 and control link 27 for the proper operating conditions. By loosening nut 40 on slide assembly 37 of speed range adjust lever 26, the operator may position point 46 to one of the index markings on slotted lever arm 36. For example, if pointer 46 is positioned, as shown in FIG. 2, at index marking A, the difference between the initial rotational speed of spool 20 and the rotational speed of spool 20 when the coil diameter 28 has reached its desired maximum, will be small. On the other hand, if pointer 46 is positioned at an index marking further from shaft 24, such as index marking D, the difference in starting and terminal rotational speeds of spool 20 will be greater. When the proper difference in rotational speed has been found, slide assembly 37 may be locked in the desired position along link 36 by tightening nut 40, as described heretofore.

Control link 27 may be adjusted in conjunction with the slide and speed range adjust lever assembly 26 to set the base winding speed of the machine. For example, if control link 27 is adjusted so that the threaded ends of rod-like members 42 and 43 are close together, lever 6 will be moved in a direction away from motor 3, thereby causing spool 20 to rotate at a higher speed, thus resulting in a higher linear speed for wire 21. On the other hand, if control link 27 is adjusted so that the distance between the threaded ends of rod-like elements 42 and 43 is widened, lever 6 will be moved in a direction toward motor 3, resulting in a slower initial rotational speed for spool 20 and consequently a slower linear wire speed.

After the slide 37 in the speed range adjust lever 26 and control link 27 have been set to their desired positions, the machine may be started and will proceed to coil wire on spool 20. As the wire diameter of coil 28 increases, speed control arm 23 will be caused to move outward, thereby rotating shaft 24 in a clockwise direction as viewed from the end of the shaft containing the speed range adjustment lever 26. This rotation will cause the speed range adjustment lever 26 to be rotated in a direction toward motor 3 and will result in link members 42 and 43, and control link 27 being moved in the same direction. The movement of the link members 42 and 43 is transmitted to lever 6, thereby causing the lever to be moved in a direction toward motor 3. As lever 6 is moved toward motor 3, the output flow of pump 4 will be decreased, causing the rotational speed of hydraulic motor 8 to decrease, thereby resulting in a slower rotational speed of spool 20. Since the outside diameter of wire 28 has increased, the slower rotational speed of spool 20 will maintain the constant linear speed of wire 21. When speed control arm 23 has been moved outwardly to the maximum desired coil diameter or weight, limit switch 45 will be actuated, disengaging motor 3 and bringing spool 20 to a halt. During the operation of the spooler, transient vibrations and movement of speed control arm 23, as transmitted to shaft 24, will be dampened by dampening the clutch 25, thereby preventing undesired variations in the rotational speed of spool 20.

A suggested procedure for determining the proper adjustment settings is as follows. With an empty spool 20 in place, the operator starts the spooler and adjusts turnbuckle 27 for the desired linear wire speed. When the spool has nearly reached its finished diameter, the linear speed may be different from that originally established. If this be the case, the operator adjusts slide assembly 37 to produce the desired speed. The finished spool is removed, an empty spool is placed on shaft 16 and arm 23 is lowered into position. The spooler is started and the operator readjusts turnbuckle 27, if necessary, to produce the desired linear speed. As this spool nears its finished diameter, slide assembly 37 is again adjusted to obtain the desired linear speed. This process is repeated as many times as necessary to obtain the required linear winding speed. It has been found empirically that the proper adjustments can be made by an experienced operator during the time required to fill approximately three spools.

Modifications may be made in the invention without departing from the spirit of it. While for purposes of an exemplary showing the speed control apparatus of the present invention has been described and illustrated in association with a hydraulically driven wire spooler, it will be obvious to one skilled in the art that the speed control apparatus may be used to vary the speed of any type of hydraulically driven winding machine, such as rolling mill take-up reels, web winders, strip annealing winders, etc., in situations where a constant linear speed of the material being wound is desired. In addition, while for purposes of an exemplary showing with a wire spooler the means for shifting the opposed ends of rod-like links 42 and 43 have been described and illustrated as a turnbuckle 27, other means may be used. The important factor here is the provisions of link means joining slide assembly 37 and lever 6, which link means may be readily adjusted in length. For example, rod-like links 42 and 43 may have a telescoping relationship whereby to increase or decrease their effective combined length, with set screw means to maintain a desired combined length.

The embodiments of the invention in which an exclusive property or privilege is claimed are defined as follows:

1. In winding apparatus of the type having driving means for operating a pump, winding means responsive to said driving means for winding material in a coil on a spool, a displacement control valve for varying the speed of said winding means, a swinging arm adapted to contact the outer surface of said coil and to be movable therewith as the diameter of said coil increases, and a rotating shaft non-rotatably affixed to said arm, the improvement, in combination therewith, comprising:

(a) lever means non-coaxially attached to said shaft;
(b) slide means adjustably connected to said lever means;
(c) speed control means operatively connected between said slide means and said displacement control valve;
(d) means for adjusting the length of said speed control means;
(e) a frictional dampening clutch attached to said shaft; and
(f) adjustable sensing means activated by the rotation of said shaft, whereby a constant linear winding speed of said material may be maintained.

2. The apparatus according to claim 1, wherein said lever means comprises a slotted link.

3. The apparatus according to claim 2, wherein said link carries a plurality of index markings.

4. The apparatus according to claim 3 wherein said slide means includes means for maintaining said slide means the positional relationship along said link slot such that said speed control means may pivot with respect to said link.

5. The apparatus according to claim 4 wherein said maintaining means includes a pointer associating with said index markings.

6. The apparatus according to claim 1 wherein said speed control means comprises a pair of coaxially connected rods.

7. The apparatus according to claim 6 wherein said adjusting means comprises a turnbuckle threadedly engaging the ends of said coaxially connected rods.

8. The apparatus according to claim 4 wherein said speed control means comprises a pair of coaxially connected rods.

9. The apparatus according to claim 8 wherein said adjusting means comprises a turnbuckle threadedly engaging the ends of said coaxially connected rods.

10. The apparatus according to claim 7 wherein said sensing means comprises an electro-mechanical switch having a manually adjustable activator.

* * * * *